US009334637B2

(12) United States Patent
Biju Duval

(10) Patent No.: US 9,334,637 B2
(45) Date of Patent: May 10, 2016

(54) MODULAR CONSTRUCTION FOR AN ELECTRONIC TAP

(71) Applicant: Les ROBINETS PRESTO, Montrouge (FR)

(72) Inventor: Rémi Biju Duval, Saint Georges de Didonne (FR)

(73) Assignee: Les ROBINETS PRESTO, Montrouge (FR)

( * ) Notice: Subject to any disclaimer, the term of this patent is extended or adjusted under 35 U.S.C. 154(b) by 0 days.

(21) Appl. No.: 14/411,584

(22) PCT Filed: May 29, 2013

(86) PCT No.: PCT/FR2013/000135

§ 371 (c)(1),
(2) Date: Dec. 29, 2014

(87) PCT Pub. No.: WO2014/001654

PCT Pub. Date: Jan. 3, 2014

(65) Prior Publication Data

US 2015/0159353 A1 Jun. 11, 2015

(30) Foreign Application Priority Data

Jun. 29, 2012 (FR) ..... 12 01847

(51) Int. Cl.
*E03C 1/04* (2006.01)
*E03C 1/05* (2006.01)

(52) U.S. Cl.
CPC .. *E03C 1/055* (2013.01); *E03C 1/04* (2013.01)

(58) Field of Classification Search
CPC ..... E03C 1/0404
USPC ..... 4/675–678
See application file for complete search history.

(56) References Cited

U.S. PATENT DOCUMENTS 6,082,407 A 7/2000 Paterson et al.

FOREIGN PATENT DOCUMENTS

| | | | |
|---|---|---|---|
| EP | 0 307 105 | A1 | 3/1989 |
| WO | WO 02/23072 | A1 | 3/2002 |
| WO | WO 2012/056238 | A1 | 5/2012 |

*Primary Examiner* — Lori Baker
(74) *Attorney, Agent, or Firm* — Renner, Kenner, Greive, Bobak, Taylor & Weber

(57) ABSTRACT

A device forming a high frequency use electronic tap for a washbasin, which defines a water circuit between a water inlet point and a water outlet point and which comprises means for opening/closing the water circuit. The means for opening/closing the water circuit are characterized in that it comprises a baseplate for fixing to a basin; the baseplate, the water circuit between the water inlet point and water outlet point, and the opening/closing device are assembled in a base element; and a shell is provided which forms the outer casing of the tap and which comprises a water inlet opening and a water outlet opening. The shell covering the base element such that the water outlet is located facing the water outlet opening and the baseplate is located facing the water inlet opening.

13 Claims, 5 Drawing Sheets

MODULAR CONSTRUCTION FOR AN ELECTRONIC TAP

FIELD OF INVENTION

The present invention relates to a device forming a tap, in particular an electronic tap, in particular for a washbasin, in particular designed for high frequency use, for example in a hospital, a motorway service station or public places etc.

BACKGROUND OF THE INVENTION

Devices are already known that form an electronic tap for a washbasin of this kind, which comprise a water circuit between a water inlet point and a water outlet point, means for controlling the opening/closing of the water circuit, in particular an electronically-controlled valve, the assembly being integrated into a main part known as a body which is fixed to the bowl of the washbasin. The device forming the tap of the prior art has disadvantages. In particular, the body forming the main part of the tap has a complex structure and has to receive or form on the inside different constituent elements, such as the electronically-controlled valve, the inlet, the outlet, the supply pipe and possibly a mixing device etc. Furthermore, if the tap is defective in order to repair it it is necessary to remove the body from the basin, which means that it is necessary to completely disconnect all of the elements of the water supply network.

The present invention aims to overcome the disadvantages of the prior art by proposing a device forming a tap, in particular for a washbasin, the maintenance of which, in particular access to different elements of the water circuit between the inlet point and the outlet point, for example elements ensuring the opening/closing of the water circuit, is made much easier in comparison to the prior art, by making it possible in particular to perform maintenance of this kind without having to disconnect the water supply network.

SUMMARY OF THE INVENTION

According to the invention a device forming a tap, in particular an electronic tap for a washbasin, in particular for high frequency use, which defines a water circuit between a water inlet point and a water outlet point and which comprises opening/closing means of the water circuit, is as defined in claim 1 and refinements thereof are defined in the subordinate claims.

Thus, according to the invention by means of the shell forming the outer casing of the tap which is independent of the technical element of the tap, and in particular of the water circuit and the opening/closing device of the water circuit, when it is necessary to perform maintenance operations on the circuit or the opening/closing device, for example an electronically-controlled valve, it is not necessary to remove the assembly of the tap from the basin and it is simply necessary to disconnect the shell from the baseplate to obtain easy access to the technical element. Furthermore, an additional advantage is that it is possible to provide a plurality of shells which have different external features from one another, corresponding to different commercial products, which can each be adapted to the same said technical element, thus reducing the number of parts necessary in stock. Furthermore, the implementation of the new product is facilitated by the fact that it is possible to work either on the technical element and maintain the same shell, or keep the same technical element and modify the shell, which increases the possible options for new taps and simplifies their design and implementation.

According to a preferred embodiment of the invention, the technical element, in particular the water outlet point, is also fixed in a detachable manner to the water outlet opening of the shell.

According to a preferred embodiment of the invention, the opening/closing means of the water circuit comprise an electronically-controlled valve.

According to a particularly simple embodiment of the invention the baseplate is in the form of a substantially circular disc and the detachable fixing means of the baseplate to the opening of the baseplate of the shell are formed on the one hand by at least one lug, preferably a plurality of lugs, projecting laterally from the lateral wall of the baseplate, and on the other hand by at least one groove, preferably a plurality of grooves, formed in the interior wall of the opening, the groove or grooves receiving the lug or lugs to allow the detachable securing of the baseplate to the opening of the baseplate of the shell.

According to a preferred embodiment of the invention, each lug is arranged at a distance from the lower face of the baseplate and each corresponding groove comprises a first section extending from the outer edge of the opening of the baseplate having a transverse dimension complementary to that of the lug, over a height corresponding to the distance between the lower face of the baseplate and the lug, and a second section with a greater width than the first section, in particular with a width between 1.1 and 1.5 times the width of the first section, such that the lug is introduced into the first section, then slid upwards until it reaches the second section, by a simple rotation of several degrees of the shell, the lug locks against the shoulder formed between the second section and the first section so as to lock all mutual relative movement between the shell and the baseplate in vertical direction, a simple rotation of several degrees in the other direction allowing unlocking.

According to another embodiment of the invention, which can also be complementary to the preceding embodiments, it is possible to provide at least one protuberance, preferably a plurality of protuberances, each penetrating into respective complementary notches, each protuberance extending over the whole height of the lateral wall of the baseplate between the lower face and the upper face of the baseplate, the traversing holes being formed in the wall of the shell at the level of notches, and holes being formed in each protuberance such that when the baseplate is inserted into the opening of the baseplate, the hole or holes of the notches are aligned with the hole or holes of the protuberances and it is then possible to screw them together respectively by means of a screw.

According to a preferred embodiment of the invention, the screw enabling the connection of the facing holes is a screw with a conical head, such that from the exterior, the more one tries to unscrew it and remove it, the more the conical head penetrates into the hole of the notch by the interior and bears against its side, thus further preventing the mutual displacement of the shell and the baseplate.

According to a preferred embodiment of the invention the shell comprises a cover. In particular, this cover can comprise means for locking the technical element to the water outlet opening of the shell in a detachable manner, in particular the water outlet point of the technical element.

BREIF DESCRIPTION OF THE DRAWINGS

An embodiment of the invention is described in the following solely by way of example with reference to the drawings in which.

DETAILED DESCRIPTION OF ILLUSTRATIVE EMBODIMENTS

Figure 1:
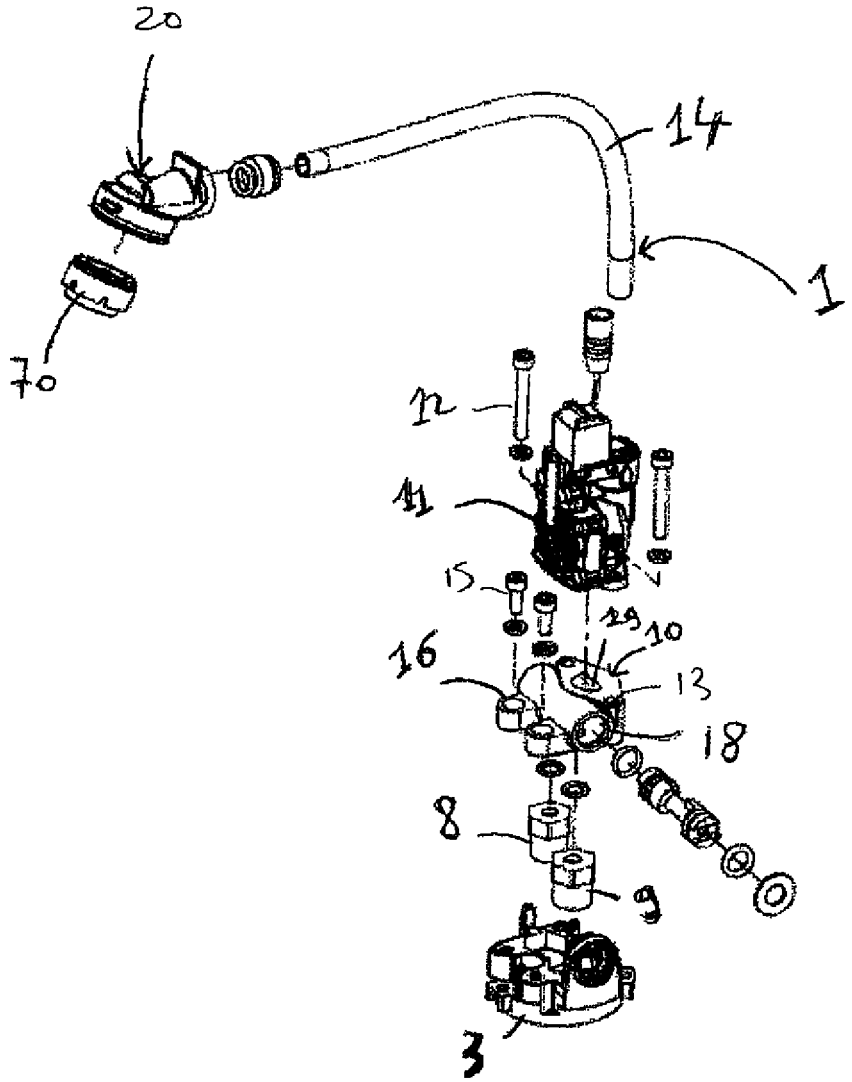
FIG. 1 is an exploded perspective view of a so-called technical element of the device forming a tap according to an embodiment of the invention.
Figure 2:
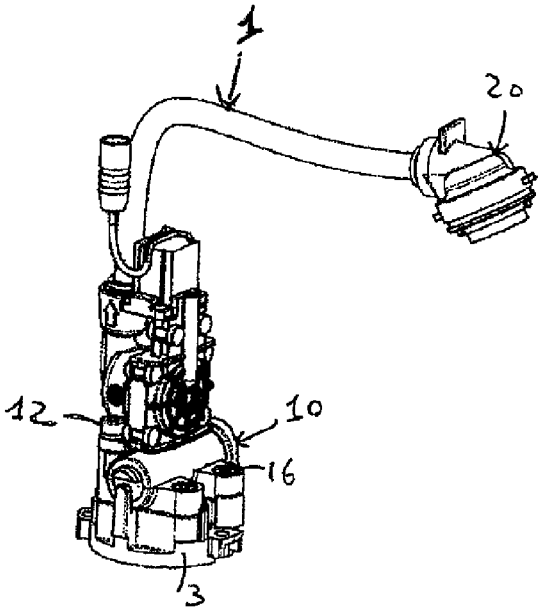
FIG. 2 is a view of the technical element of FIG. 1 in the assembled state.

FIGS. 1 and 2 show an element 1, referred to as a technical element, of a device according an embodiment of the invention. This device according to an embodiment of the invention is formed by the technical element 1 and a covering shell 2 shown in FIGS. 3, 4, 7 and 10 to 14.

FIG. 1 shows the different constituent elements of the technical element 1 in an exploded view. FIG. 2 shows the same technical element 1 of FIG. 1 in an assembled state. The technical element 1 comprises a baseplate 3, substantially in the form of a circular disc or plate designed to be fixed on the one hand to the bowl of a washbasin and on the other hand in a detachable manner to the interior wall of the side 4 of an opening 5 of the baseplate formed in the lower part of the shell 2.

Figure 5:
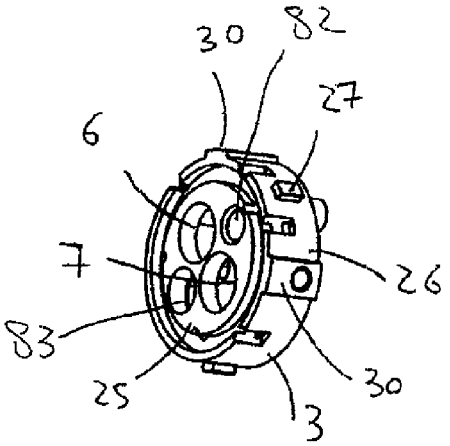
FIGS. 5 and 6 are perspective views shown from below and from above the baseplate of FIGS. 1, 2 and 4.
Figure 6:
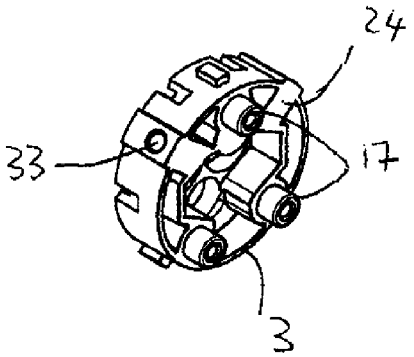
Figure 8:
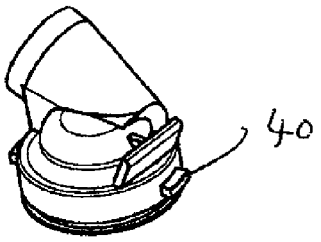
FIG. 8 is a perspective view of the aerating end piece forming the water outlet point of the device of the embodiment shown in the preceding figures.
Figure 9:
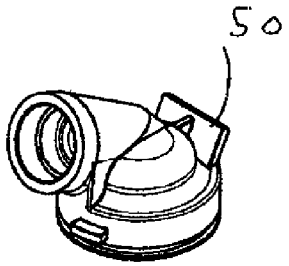
FIG. 9 is a perspective view from a different direction of the aerating end piece of FIG. 8.
Figure 7:
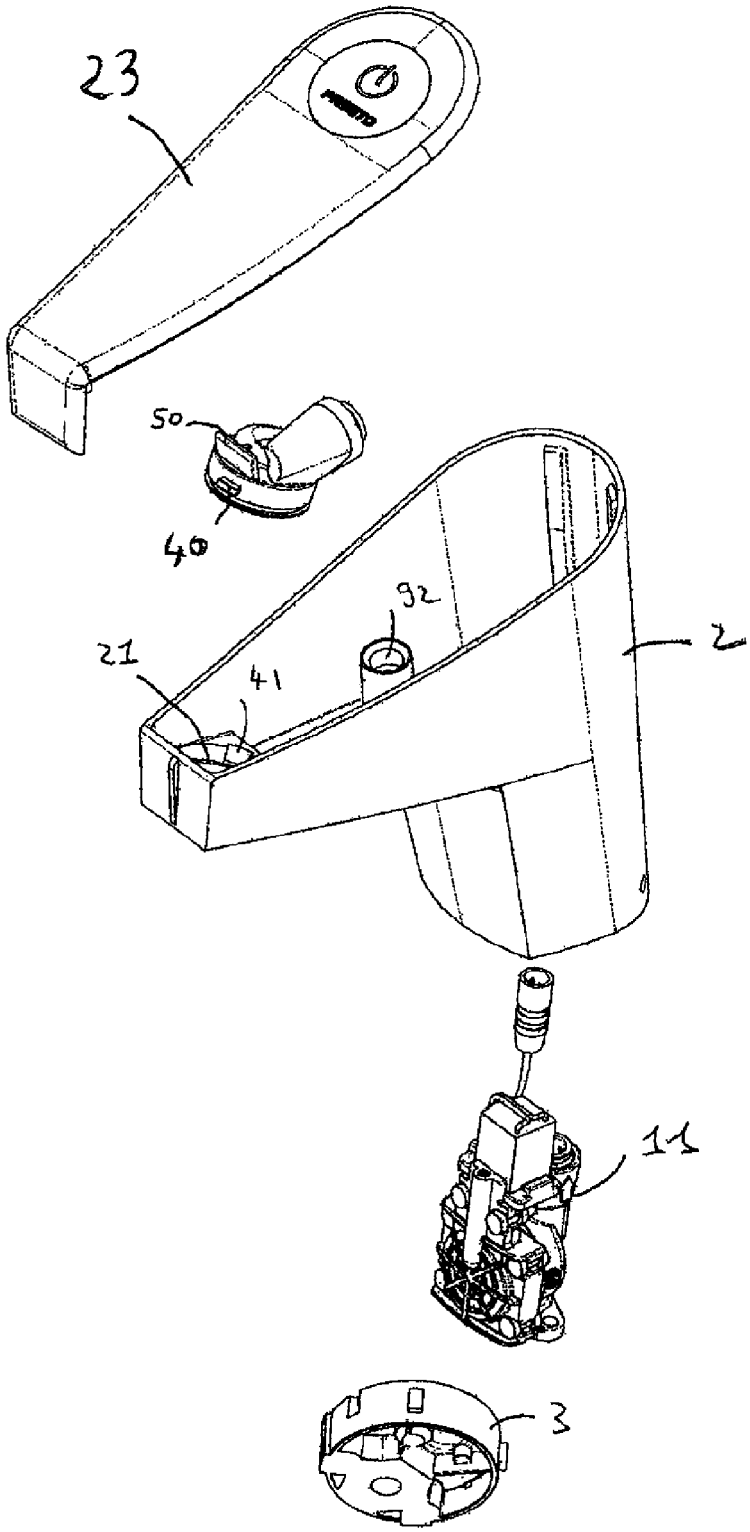
FIG. 7 is an exploded perspective view of the different elements of the device forming a tap of FIG. 3, only without the water pipe.
Figure 10:
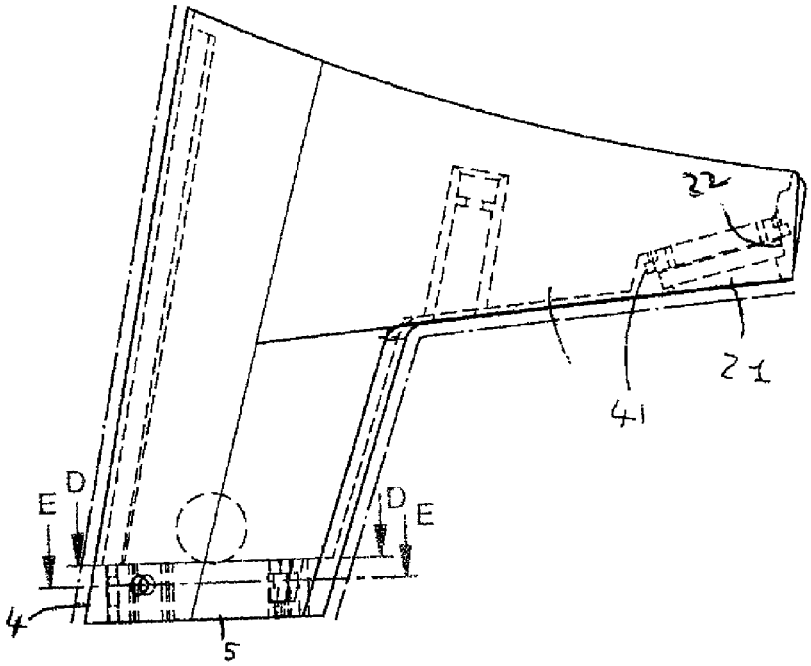
FIG. 10 is a side view of the shell of the device of the preceding figures.
Figure 14:
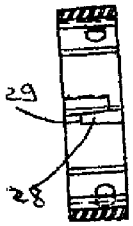
FIG. 14 is a cross section along the line G-G of FIG. 11.
Figure 11:
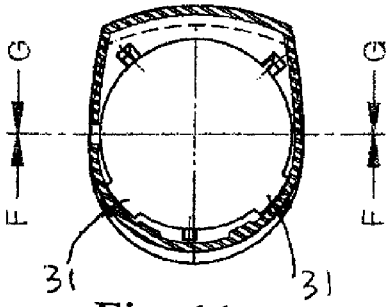
FIG. 11 is a cross section along the line D-D of FIG. 10.
Figure 13:
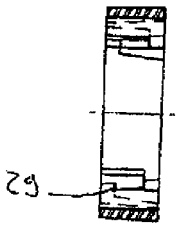
FIG. 13 is a cross section along the line F-F of FIG. 11.
Figure 12:
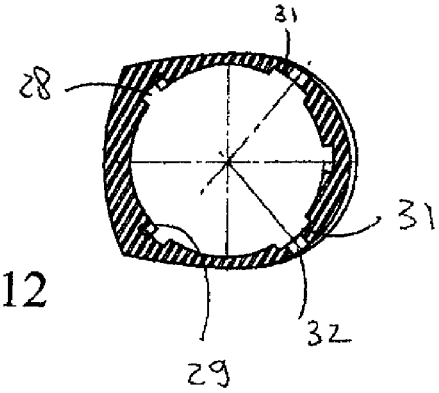
FIG. 12 is a cross section along the line E-E of FIG. 10.

Said baseplate 3 is shown in a more precise manner in FIGS. 5 and 6. The baseplate 3 is pierced by two transverse holes 6 and 7 which receive two end pieces 8 and 9 respectively designed for connecting to the supply network of hot water and cold water respectively through pipes (not shown in the figures) entering from below the baseplate 3.

The technical element 1 comprises, following the baseplate 3, a mixing device 10 which is fixed to the upper face of the baseplate 3. According to another embodiment of the invention it is possible to provide said mixing device upstream of the baseplate, that is at the level of the basin and single water supply pipe, coming from the mixer at the level of the basin, entering into the baseplate, instead of two pipes as in the embodiment of the invention shown in the figures. The present invention clearly covers these two embodiments effectively, the water inlet point being formed in one case by two end pieces 8, 9 and in the other by a single end piece.

The mixing device 10 is positioned relative to the baseplate 3 by the cooperation of three cylindrical holes 16 which cover three lugs 17 emerging from the upper face of the baseplate and screws which ensure the mutual fixing of the holes 16 and lugs 17. The mixing device also comprises a horizontal pipe 18 pierced by two holes (not shown in the figures) facing the end pieces 8 and 9 and through which water can pass in the pipe 18 where there is a mixing cylinder ensuring the mixing of hot and cold water coming from the end pieces 8 and 9 to allow the outlet of the mixture upwards through a hole 19 opening into the upper part of the mixing stage 10.

Above the mixing device is an electronically-controlled valve 11 which is fixed to the mixing device by means of screws 12 which penetrate corresponding holes 13 formed on the upper face of the mixing stage 10. Following the electronically-controlled valve a pipe 14 extends for the passage of water towards an end piece 20 forming the water outlet.

The so-called technical assembly 1, which thus comprises a water inlet point at the level of the two end pieces 8 and 9 for supplying water and a water outlet point at the level of the end piece 20, forms with the covering shell 2 a tap device according to the invention. The shell 2 comprises a lower opening 5, the inner side 4 of which is designed to cooperate with the baseplate 3 to ensure the mutual detachable fixing of the shell and the baseplate. The shell 2 also comprises an opening 21 the inner side 22 of which is designed to cooperate with the end piece 20 for the detachable mutual securing of the end piece and the shell. A cover 23 closes the interior space of the shell from above.

The baseplate 3 is substantially in the form of a circular disc with an upper face 24, a lower face 25 and a lateral face 26. Three lugs 27 of rectangular shape project from the wall 26 and are distributed substantially uniformly at an angle to the lateral face 26. Each lug 27 with a rectangular shape is spaced apart from the lower face 25. Said rectangular lugs 27 are designed to cooperate with corresponding grooves 28 formed in the interior wall of the side 4 of the lower opening 5 of the shell 2 to ensure the detachable mutual fixing of the baseplate to the shell.

Said grooves 28 are shown in detail in particular in FIGS. 11 to 14. They each comprise a first section of the same width as the width of the rectangular lug 27 which extends over a height corresponding to the distance of the lug 27 from the lower face 25 of the baseplate 3. The groove 28 comprises after this section a section with a greater width than the first section and which extends over a height substantially equal to the length of the lug 27. This second section of the groove 28 with a larger width forms a shoulder 29 with the first section. Thus, when the lugs 27 cooperate with the grooves 28, they penetrate through the first section, then having reached the second section the shell is pivoted slightly such that the lug 27, fully received in the second section, abuts against the shoulder 29 so as to fix the baseplate 3 to the shell 2 in a detachable manner preventing all movement in vertical direction. The baseplate 3 also comprises two protuberances 30 with a rectangular form which extend over the whole height of the lateral face 26 of the baseplate 3. Said rectangular protuberances 30 are associated with complementary grooves 31 formed in the inner wall of the side 4 of the opening 5. Said grooves 31, with a complementary shape to the rectangular protuberances 24, are each pierced with traverse holes 32 respectively.

Likewise, the protuberances 30 are pierced with oblong holes 33, corresponding with holes 32 when the protuberances 30 are located in the grooves 31. It is then possible to ensure the screwing of the baseplate 3 to the shell 2 by means of a screw (not shown) and in particular by means of screws with a conical head, mounted in such a way that from the exterior the more one tries to unscrew the screw to remove it from the hole 32, the more the conical head is pressed against the side of the hole 32 and the more the mutual fixing of the baseplate to the shell is locked, which makes it possible to prevent people with malicious intentions trying to remove the tap from the basin.

Figure 3:
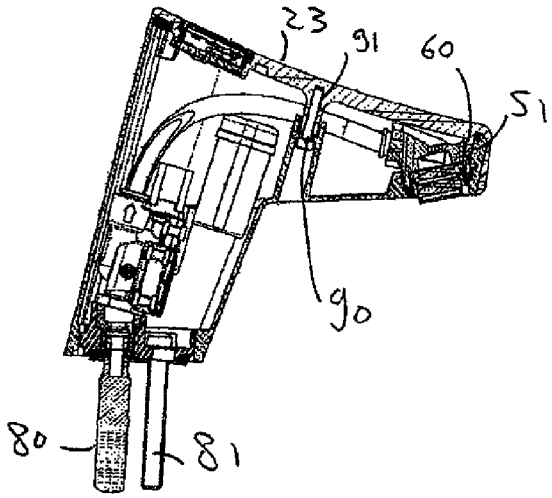
FIG. 3 is a cross section from the side of a tap device of the invention formed by the technical element of FIGS. 1 and 2 and a shell also shown in the following FIGS. 4, 7 and 10 to 14.
Figure 4:
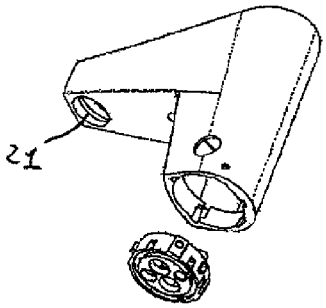
FIG. 4 is a perspective view from below of the shell of FIG. 3 as well as the baseplate of the technical element of FIGS. 1 and 2.

The baseplate 3 can be fixed to the basin, as shown in FIG. 3, by means of screws 80, 81 and associated holes 82, 83 opening towards the lower face of the baseplate.

The end piece 20 forming the water outlet point which is arranged at the end of the pipe outlet 14 is received in a kind of housing formed by the inner edge 22 of the water outlet opening 21 of the shell 2. The end piece 20 comprises a part forming a base pedestal with a substantially circular cylindrical form of the lateral wall from which two diametrically opposite lugs 40 project, which penetrate into the respective grooves 41 formed in the inner wall of the side 22. Said grooves 41 are the same type as grooves 28 and each comprise a first section with a width that is substantially identical to the width of the lugs 40 and a second section with a greater width which forms a shoulder with the first section. Thus when the end piece 20 is inserted via its pedestal into the receiving housing, the two lugs 40 are aligned with the first sections, then the assembly is pushed towards the outlet 21 such that the lugs reach the level of the second section, from which moment the pedestal is subjected to a slight rotation, so that the shoulder formed between the two sections of different widths locks the assembly so as to prevent any movement in vertical direction. Furthermore, on the upper surface of the end piece 20 a rectangular plate 50 projects upwards which when the end piece is locked in vertical position by the cooperation of the lugs 40 and grooves 41 is at a distance from an inner front wall 51 of the shell 2. Thus a gap is formed between the front wall 51 on the inside of the shell 2 and this plate 50. Thus, a plate 60 with a complementary form to said gap projects downwards, such that when the shell 2 is closed by the cover 23, said plate 60 coming from the cover 23 penetrates into the gap between the plate 50 and the front wall 51 of the shell in order to prevent in this way any mutual rotation between the end piece 20 and the shell 2 thus fixing the end piece 20 in a fixed position in translation and rotation.

As shown in FIG. 3, the cover 23 is fixed to the shell by means of a screw 90 and two holes 91 and 92 formed in protuberances emerging respectively from the inner surface of the cover and from the inner lower face of the shell, the hole 92 formed in the shell being traverse.

At the end of the side of the opening 21, it is possible to attach a water aeration washer in the form of an aerating end piece 70, which is standard in this field, to the end piece 20.

The invention claimed is:

1. A high frequency use tap forming device comprising:

a water circuit defined between a water inlet point connected to a water supply network and a water outlet point for the delivery of water, means for opening/closing of said water circuit and a baseplate, wherein said baseplate, said water circuit and said opening/closing means are assembled in a base element referred to as a technical element; wherein said device further comprises:

a shell forming an outer casing for said tap and having a water inlet opening and a water outlet opening, said shell being disposed to cover said technical element;

said water outlet point located opposite said water outlet opening and said baseplate located opposite said water inlet opening; and a detachable means for securing and fixing in a detachable manner said shell to said baseplate such that said shell is removable to enable free access to said technical element without disconnecting said technical element from said water supply network.

2. Device according to claim 1, characterized in that the technical element is also fixed in a detachable manner to the water outlet opening of said shell.

3. Device according to claim 1, characterized in that said opening/closing means of said water circuit comprises an electronically-operated valve.

4. Device according to claim 1, said detachable means is formed on the one hand by at least one lug projecting laterally from a lateral wall of said baseplate, and on the other hand at least one groove formed in an interior wall of the side of the opening, said groove receiving said lug allow the detachable fixing of said baseplate to the opening of said baseplate of said shell.

5. Device according to claim 4, characterized in that said baseplate is in the form of a substantially circular disc.

6. Device according to claim 4, characterized in that each lug is arranged at a distance from a lower face of said baseplate and each corresponding groove comprises a first section extending from an outer side of the opening of said baseplate having a transverse dimension complementary to that of said lug, over a height corresponding to the distance between the lower face of said baseplate and said lug, and a second section with a greater width than the first section, such that said lug is introduced into said first section, then slid upwards until said lug reaches said second section, by a simple rotation of several degrees of said shell, said lug is then locked against a shoulder formed between said second section and said first section in order to lock in vertical direction any mutual relative movement between said shell and said baseplate, a simple rotation of several degrees in the other direction enabling unlocking.

7. Device according to claim 1, characterized in that at least one protuberance is provided which each penetrate into respective complementary notches, each protuberance extending over a whole height of the lateral wall of said baseplate, between a lower face and an upper face of said baseplate, traversing holes being formed in the wall of said shell at a level of said notches and holes being formed in each protuberance, such that when said baseplate is inserted into the opening of said baseplate, the hole or holes of said notches are aligned with the hole or holes of said protuberances and it is possible to connect them respectively by means of a screw.

8. Device according to claim 1, characterized in that said shell comprises a cover.

9. Device according to claim 8, characterized in that said cover comprises means for locking in a detachable manner said technical element at the water outlet opening of said shell.

10. Device according to claim 9, characterized in that said means for locking said technical element at the water outlet opening of the shell comprises a plate with a complementary shape of a gap formed between a end piece and said shell.

11. Device according to claim 1, characterized in that said tap is an electronic tap for a water basin.

12. Device according to claim 11, characterized in that said baseplate is fixated to said water basin.

13. Device according to claim 12, characterized in that said shell can be removed to enable free access to said technical element without having to disconnect said baseplate from said water basin.

* * * * *